US008196925B2

(12) United States Patent
Richards et al.

(10) Patent No.: US 8,196,925 B2
(45) Date of Patent: Jun. 12, 2012

(54) SHEET TRANSPORT SYSTEM WITH MODULAR NIP RELEASE SYSTEM

(75) Inventors: Paul N. Richards, Fairport, NY (US); Lloyd A. Williams, Mahopac, NY (US); Joannes N. M. DeJong, Hopewell Junction, NY (US); Matthew Dondiego, West Milford, NJ (US)

(73) Assignee: Xerox Corporation, Norwalk, CT (US)

( * ) Notice: Subject to any disclaimer, the term of this patent is extended or adjusted under 35 U.S.C. 154(b) by 359 days.

(21) Appl. No.: 12/495,233

(22) Filed: Jun. 30, 2009

(65) Prior Publication Data

US 2010/0327513 A1 Dec. 30, 2010

(51) Int. Cl.
*B65H 5/02* (2006.01)
*B65H 5/04* (2006.01)

(52) U.S. Cl. ..... 271/274; 271/273

(58) Field of Classification Search ..... 271/273, 271/274

See application file for complete search history.

(56) References Cited

U.S. PATENT DOCUMENTS

| | | | | |
|---|---|---|---|---|
| 4,346,883 | A * | 8/1982 | Speraggi | 271/274 |
| 4,558,373 | A * | 12/1985 | Plasencia et al. | 358/484 |
| 5,182,861 | A * | 2/1993 | Suzuki et al. | 33/18.1 |
| 6,338,483 | B1 * | 1/2002 | Andela et al. | 271/227 |
| 7,967,289 | B2 * | 6/2011 | Tharayil et al. | 271/274 |
| 2006/0071419 | A1 * | 4/2006 | Lee | 271/272 |
| 2006/0145416 | A1 * | 7/2006 | Giese | 271/273 |
| 2008/0042340 | A1 * | 2/2008 | Linder et al. | 271/274 |
| 2010/0013150 | A1 * | 1/2010 | Bryl | 271/274 |
| 2010/0090391 | A1 * | 4/2010 | deJong et al. | 271/8.1 |
| 2011/0049801 | A1 * | 3/2011 | deJong et al. | 271/274 |

FOREIGN PATENT DOCUMENTS

| | | | |
|---|---|---|---|
| DE | 3545304 | A1 * | 7/1987 |
| JP | 52006598 | A * | 1/1977 |
| JP | 04365734 | A * | 12/1992 |

* cited by examiner

*Primary Examiner* — Kaitlin Joerger
*Assistant Examiner* — Prasad Gokhale
(74) *Attorney, Agent, or Firm* — Hoffmann & Baron, LLP

(57) ABSTRACT

A sheet transport system and method including a first drive module including a frame. A first drive wheel is rotatably disposed on the frame. A first drive motor is operably connected to the first drive wheel and disposed on the frame. The first drive module is pivotally secured to a structure. A first idler wheel corresponds to the first drive wheel. An actuator is operably engagable with the first drive module. The actuator is configured to move the first drive module to cause the first drive wheel to move between an open position and a closed position. The first drive wheel is configured to propel a sheet in the closed position and to not propel a sheet in the open position.

19 Claims, 7 Drawing Sheets

SHEET TRANSPORT SYSTEM WITH MODULAR NIP RELEASE SYSTEM

TECHNICAL FIELD

The present disclosure generally relates to document processing devices and methods for operating such devices. More specifically, the present disclosure relates to methods and systems for maintaining accurate alignment of an idler wheel in a releasable nip system.

BACKGROUND

Document processing devices typically include one or more sets of nips used to transport media (i.e., sheets) within the device. A nip provides a force to a sheet as it passes through the nip to propel it forward through the document processing device. Depending upon the size of the sheet that is being transported, one or more nips in a set of nips might not contact the sheet as it is being transported.

FIG. 1A depicts a top view of a portion of an exemplary document processing device known in the art. As shown in FIG. 1A, the document processing device 100 includes three sets of nips 105*a-b*, 110*a-b*, and 115*a-b*. The first set of nips 105*a-b* are used to transport a sheet; the second set of nips 110*a-b* are used to perform sheet registration; and the third set of nips 115*a-b* are used to transport a sheet in a process direction. Although two nips are shown for each set of nips, additional or fewer nips can be used. In some cases, additional nips are used to account for variations in sheet size during the transport or registration processes.

As shown in FIG. 1B, each nip in a set of nips, such as 115*a-b*, includes a drive wheel, such as 125, and an idler wheel, such as 130. A normal force is caused at each nip by loading the idler wheel 130. Friction between the sheet and each nip 115*a-b* is used to produce a normal force that propels the sheet in a process direction. Typically, each idler wheel 130 is mounted independently from the other idler wheels in a set of nips.

Transferring a sheet in the process direction to consecutive sets of nips 115*a-b* or to another station within a document processing device 100 (e.g., to receive an image from a photoreceptor) requires each nip pair to open and close. In conventional systems, the idler wheels 130 are part of a moveable mechanism connected to an actuator that opens and closes the nip. When traveling through the nip, the trajectory of the sheet is greatly influenced by the alignment of the idler wheels. Therefore, the proper alignment of the idler wheels is important to achieve accurate and repeatable sheet motion and prevent skewing of the sheet. With the idler wheels repeatedly moving between the open and closed position, the proper alignment thereof is difficult to maintain.

SUMMARY

Before the present systems, devices and methods are described, it is to be understood that this disclosure is not limited to the particular systems, devices and methods described, as these may vary. It is also to be understood that the terminology used in the description is for the purpose of describing the particular versions or embodiments only, and is not intended to limit the scope.

It must also be noted that as used herein and in the appended claims, the singular forms "a," "an," and "the" include plural references unless the context clearly dictates otherwise. Thus, for example, reference to a "nip" is a reference to one or more nips and equivalents thereof known to those skilled in the art, and so forth. Unless defined otherwise, all technical and scientific terms used herein have the same meanings as commonly understood by one of ordinary skill in the art. Although any methods, materials, and devices similar or equivalent to those described herein can be used in the practice or testing of embodiments, the preferred methods, materials, and devices are now described. All publications mentioned herein are incorporated by reference. Nothing herein is to be construed as an admission that the embodiments described herein are not entitled to antedate such disclosure by virtue of prior invention. As used herein, the term "comprising" means "including, but not limited to."

In an embodiment, a sheet transport system may include a first drive module including a frame. A first drive wheel is rotatably disposed on the frame. A first drive motor is operably connected to the first drive wheel and disposed on the frame. The first drive module is pivotally secured to a structure. A first idler wheel corresponds to the first drive wheel. An actuator is operably engagable with the first drive module. The actuator is configured to move the first drive module to cause the first drive wheel to move between an open position and a closed position. The first drive wheel is configured to propel a sheet in the closed position and to not propel a sheet in the open position.

In an embodiment, a sheet transport system may include a plurality of drive modules each including a drive wheel and a drive motor operably connected to the drive wheel. The plurality of drive modules are pivotally secured to a support shaft. A plurality of idler wheels is provided with one of the plurality of idler wheels corresponding with one of the plurality of drive wheels. An actuator is operably engagable with the plurality of drive modules, wherein the actuator is configured to cause the drive wheels of the plurality of drive modules to selectively move between a closed sheet engaging position and an open non-sheet engaging position.

In an embodiment, a method of controlling a sheet transport system to reduce sheet skew may include energizing an actuator to move a drive module including a drive wheel and a drive motor from an open position to a closed position. The drive wheel cooperates with an idler wheel to form a nip, wherein the idler wheel comprises a substantially rigid outer layer, and the drive wheel comprises a substantially compliant outer layer. The drive wheel is configured to not propel a sheet in the open position and is configured to propel a sheet in the closed position. The method further includes transporting a sheet through the nip by action of the drive wheel; and energizing the actuator to move the drive module from the closed position to the open position.

BRIEF DESCRIPTION OF THE DRAWINGS

Aspects, features, benefits and advantages of the present invention will be apparent with regard to the following description and accompanying drawings, of which.

DETAILED DESCRIPTION

The following terms shall have, for the purposes of this application, the respective meanings set forth below.

A "drive module" refers to an assembly of components which may be installed or removed as a unit for imparting motion to a sheet.

A "nip" refers to a location in a document processing device at which a force is applied to a sheet to propel the sheet in a process direction. A nip may include, for example and without limitation, a drive wheel and an idler wheel.

A "frame" as used herein refers to a structural unit for supporting thereon various elements.

A "drive wheel" refers to a nip component that is designed to propel a sheet in contact with the nip. A drive wheel may comprise a compliant material, such as rubber, neoprene or the like. A drive wheel may be directly driven via a stepper motor, a DC motor or the like. Alternately, a drive wheel may be driven using a gear train, belt transmission or the like.

A "drive motor" refers to a drive module component for imparting motion.

An "idler wheel" refers to a nip component that is designed to provide a normal force against a sheet in order to enable the sheet to be propelled by the drive wheel. An idler wheel may comprise a non-compliant material, such as plastic.

An "actuator" refers to a device or devices for controlling or moving an element.

An "open position" refers to a state of a nip in which the drive wheel does not provide a normal force in the direction of the idler wheel. For example, in an open position, the drive wheel does not contact either a sheet received at the nip or the idler wheel (if a sheet is not present).

A "closed position" refers to a state of a nip in which the drive wheel provides a normal force in the direction of the idler wheel. For example, in a closed position, the drive wheel contacts either a sheet received at a nip or the idler wheel (if a sheet is not present).

The present disclosure is directed to a sheet transport system with releasable nips that maintain alignment of the idler wheels. The sheet transport system may be used in a document processing device which may include a device that performs an operation in the course of producing, replicating, or transforming a document from one format to another format, such as from an electronic format to a physical format or vice versa. Document processing devices may include, without limitation, printers (using any printing technology, such as xerography, ink-jet, or offset); document scanners or specialized readers such as check readers; mail-handling machines; fabric or wallpaper printers; or any device in which an image of any kind is created on and/or read from a moving substrate.

Figure 1A:
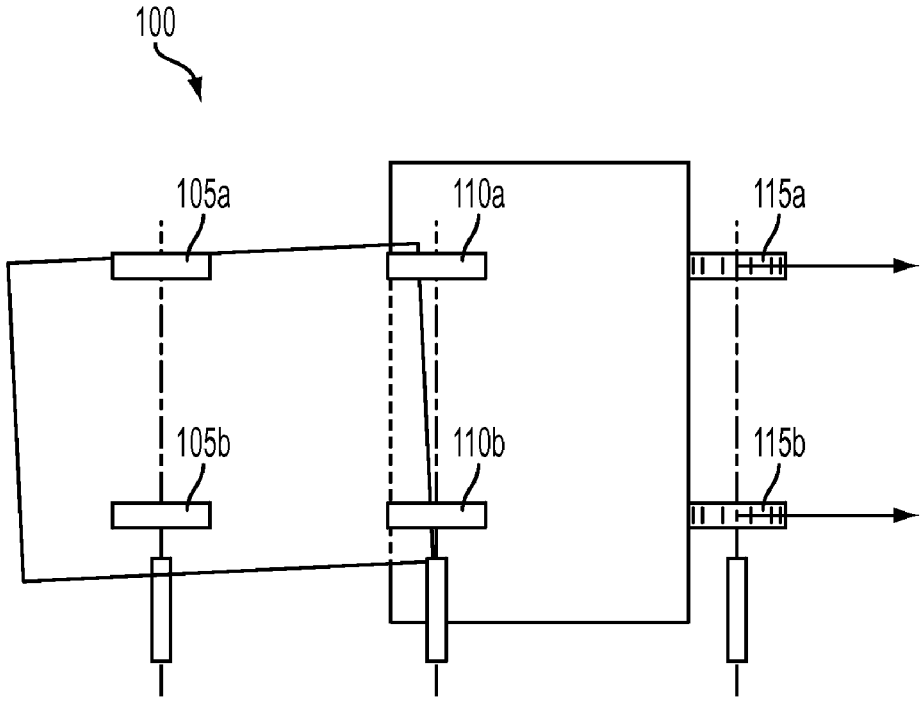
FIG. 1A PRIOR ART
FIG. 1A depicts a top view of a portion of a conventional document processing device.
Figure 1B:
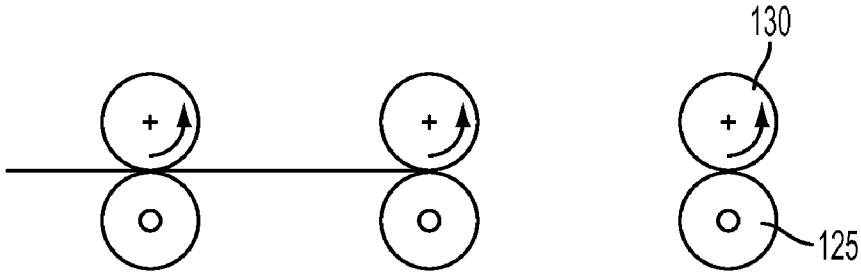
FIG. 1B PRIOR ART
FIG. 1B depicts a side elevational view of a sheet transport system for a conventional document processing device.
Figure 2:
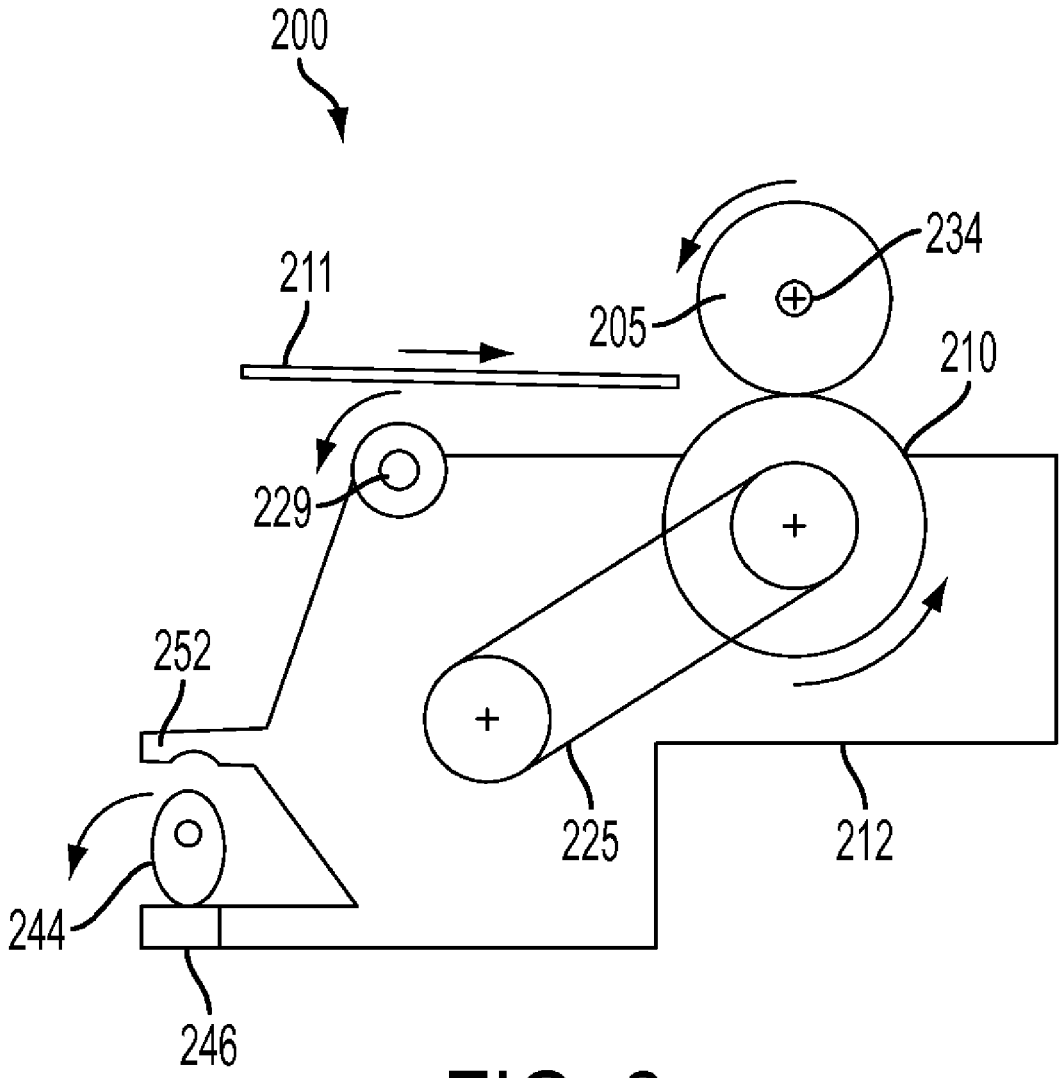
FIG. 2 depicts a side elevational view of a sheet transport system for a document processing device according to an embodiment.
Figure 3:
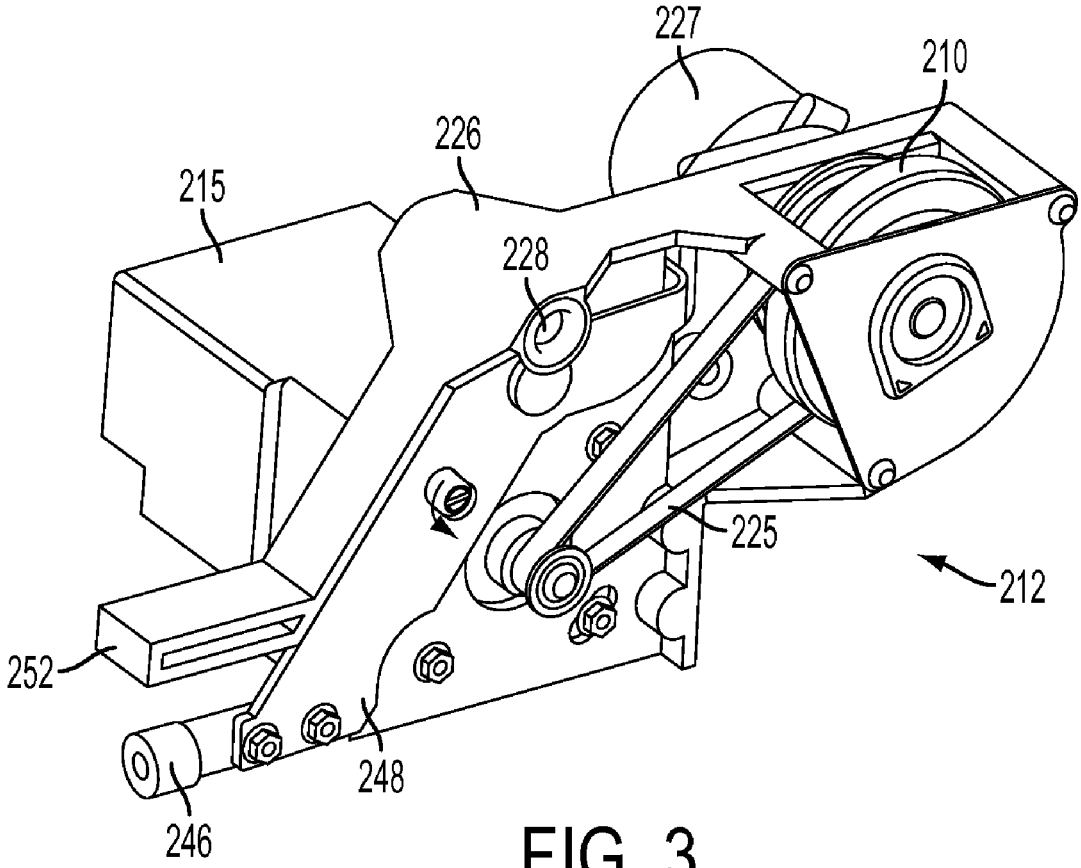
FIG. 3 depicts a front perspective view of a drive module according to an embodiment.

As shown in FIGS. 2 and 3, the sheet transport system 200 may include an idler wheel 205, and a drive module 212. The drive module may include a drive wheel 210, a drive motor 215, and a transmission device for operably connecting the drive motor 215 to the drive wheel 210.

The idler wheel 205 is a nip component designed to provide a normal force against a sheet that is being transported by the sheet transport system 200 in order to enable the sheet to be propelled by the drive wheel 210. The idler wheel 205 may comprise a non-compliant material, such as a hard plastic. The idler wheel 205 may rotate around a shaft 234. In an embodiment, the shaft may be secured to resist movement of the idler wheel 205 away from the drive wheel.

The drive wheel 210 is another nip component that is designed to propel a sheet 211 that is being transported by the sheet transport system 200. The drive wheel 210 may comprise a compliant material, such as rubber, neoprene or the like. Rotation of the drive wheel moves the sheet through the sheet transport system 200.

Figure 4:
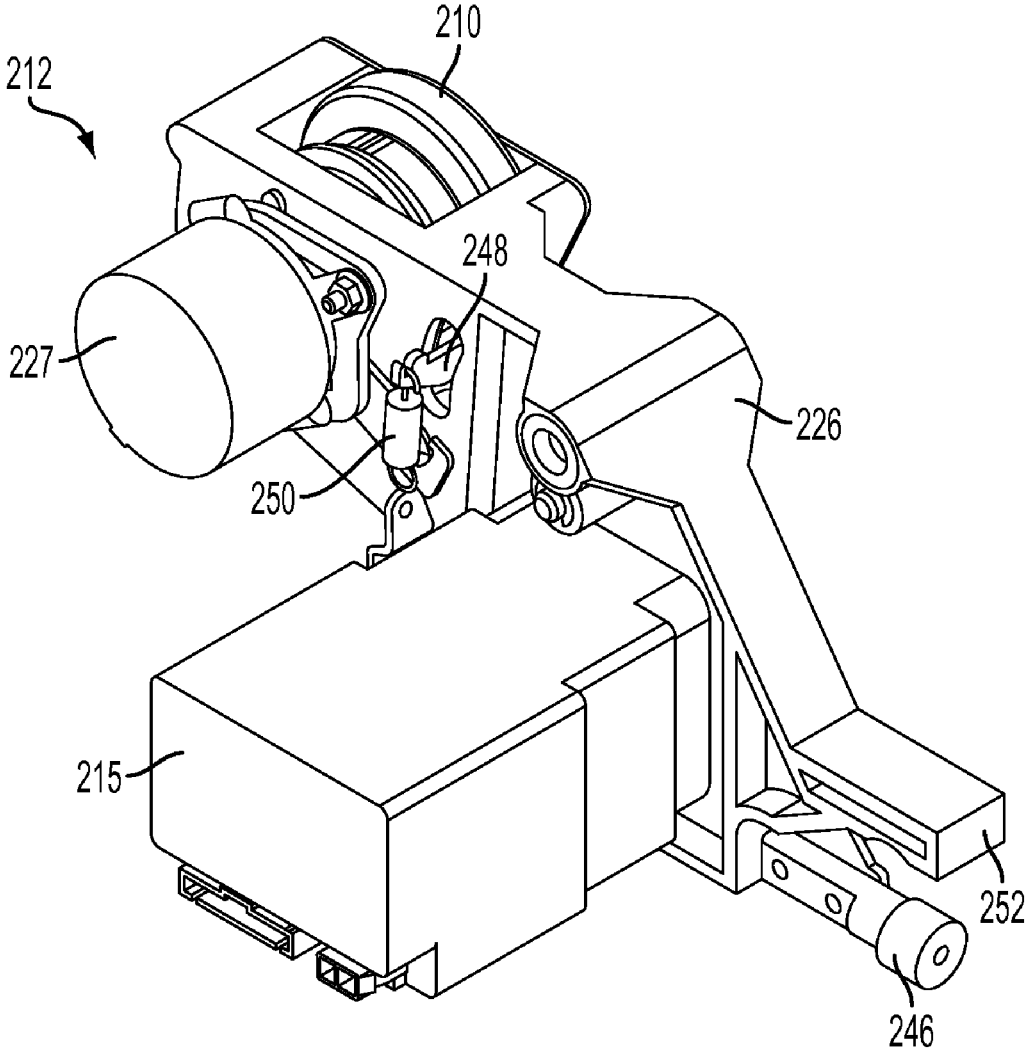
FIG. 4 depicts a back perspective view of the drive module of FIG. 3.
Figure 5:
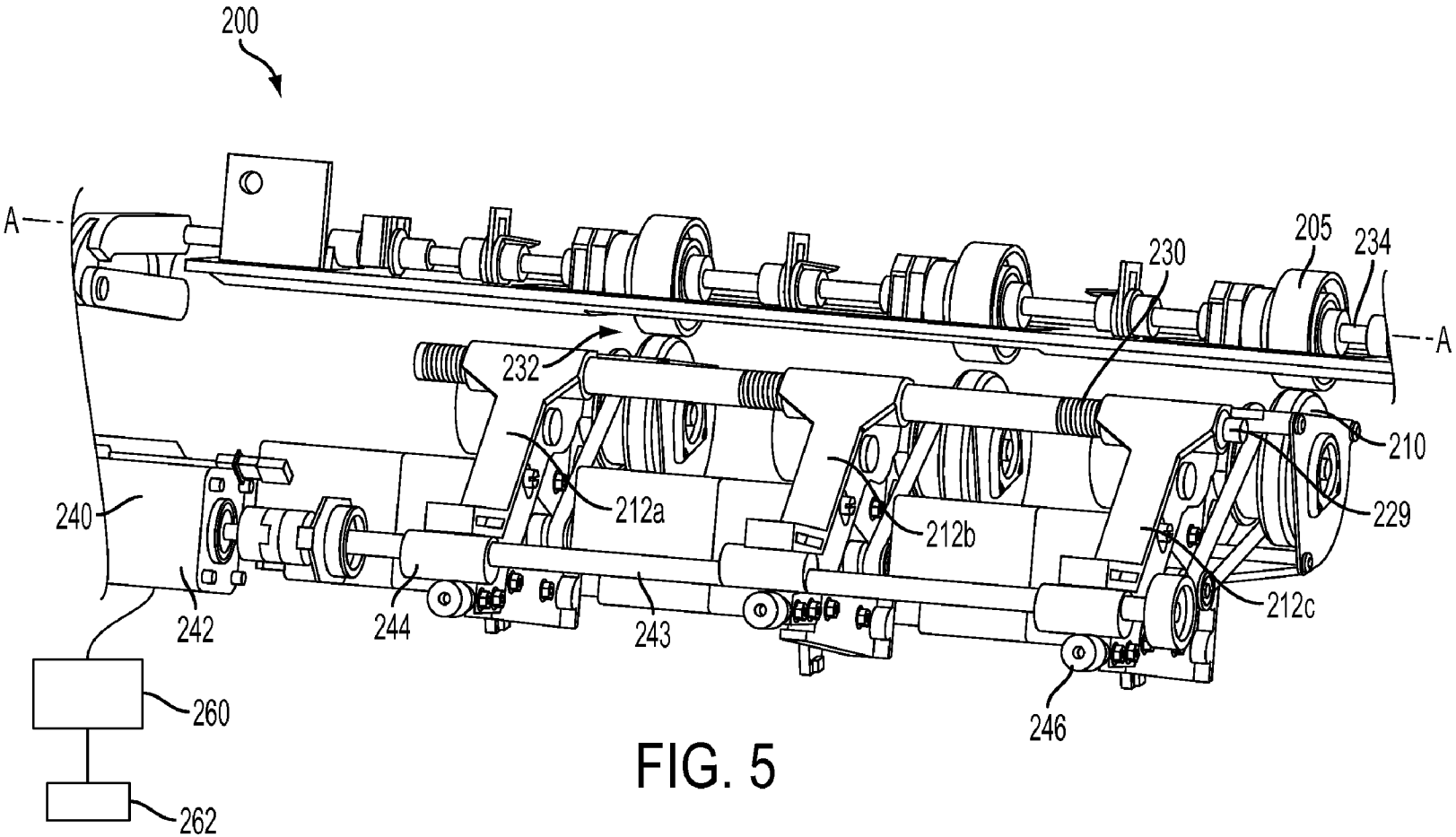
FIG. 5 depicts a perspective view of the sheet transport system showing an engagement of the drive wheels with the idler wheels.

With reference to FIGS. 3 to 5, in addition to the drive wheel 210, the drive module 212 includes a drive motor 215, such as a stepper motor, DC motor or the like. The drive module 212 may also include a transmission system 225 to operatively connect the drive wheel 210 to the drive motor 215. The transmission system 225 may include a belt drive; however, other transmission system 225, such as gear trains, are known to those of ordinary skill in the art and intended to be included within the scope of this disclosure. The drive module 212 may further include a frame 226 on which the drive wheel 210 is rotatably supported. The frame 226 may also support the drive motor 215 and an encoder 227. The encoder 227 may be operatively connected to the drive wheel 210 in order to provide feedback as to the operation of the drive wheel in a manner known in the art. The frame 226 may include a through hole 228 which may receive therein a support shaft 229. The drive module 212 and all it components may be pivotally supported on the shaft 229. Each drive module 212 may be engaged by a drive module biasing device 230 in the form of a compression spring which is disposed on the shaft 229. The drive module biasing devices 230 urge the drive modules 212 to remain in their proper position along the support shaft 229. The drive modules 212 are discrete assemblies that may be installed as a unit.

Figure 6:
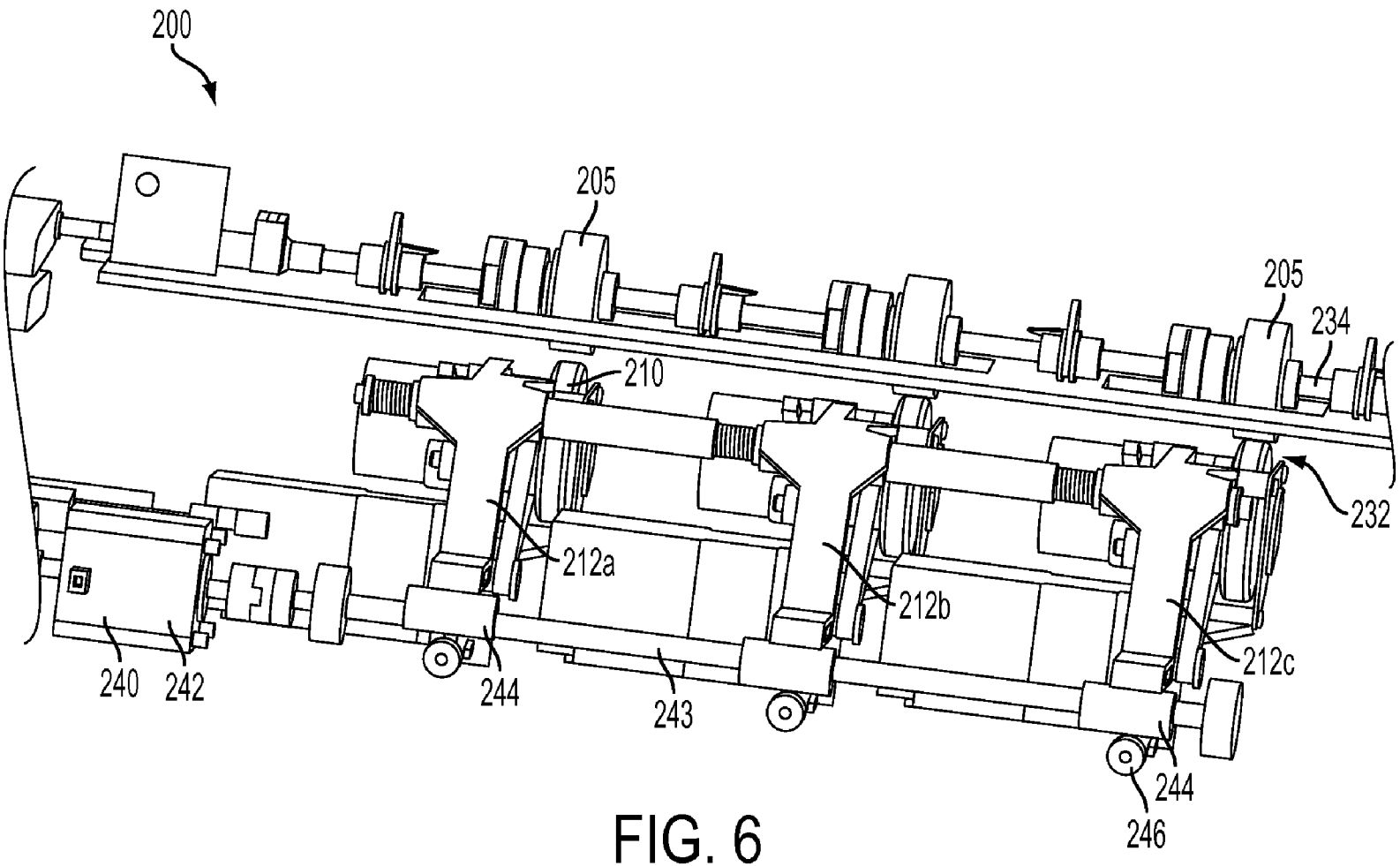
FIG. 6 depicts a perspective view of the sheet transport system showing an alternative engagement of the drive wheels with the idler wheels.

With reference to FIGS. 5 and 6, a plurality of similarly formed drive modules 212 may be arranged in a row with each being pivotally supported on the support shaft 229. The drive modules 212 are preferably mounted such that they may pivot independent of each other. A plurality of idler wheels 205 may also be arranged in a row with the drive wheels 210 of the drive modules corresponding to one of the idler wheels 205, thereby forming a plurality of nips 232. The idler wheels 205 may be located on a common shaft 234 around which each idler wheel rotates. Accordingly, a sheet passing through the sheet transport system 200 may be contacted at more than one point.

Each drive module 212 and the drive wheel 210 associated therewith may be independently positioned between an open and closed position. Such positioning of the drive wheels 210 may be achieved by an actuator 240. Actuator 240 is generally a mechanical device used to move or control a mechanism or system. The actuator 240 may be used to move or control the location of the drive wheel 210 with respect to a sheet that is transported by the sheet transport system 200. Actuator 240 permits the drive modules 212 to be independently controlled to change the open and closed operating position of the drive wheels 210. Accordingly, the actuator is capable of creating different operating conditions, with each operating condition being distinguished by which drive wheels are in the open and closed position.

Actuator 240 may include a rotary drive 242 connected to one end of a camshaft 243. The rotary drive 242 may include a motor, such as a stepper motor or DC motor, which is capable of rotating in a clockwise and counterclockwise motion. The rotary drive 242 may be capable of rotating through 270 degrees, although other ranges of motion are contemplated. The camshaft 243 may include a plurality of cams 244 secured thereon. The cams 244 are spaced along a length of the camshaft 243. The cams are positioned to selectively engage followers 246 disposed on the drive modules. The movement of the cams 244 causes the followers 246 to move and in turn cause the drive wheels 210 to pivot between the open and closed position. In an alternate embodiment (not shown), a plurality of actuators may be employed with each drive module 212 being controlled by a separate actuator. In the closed position, the sheet is gripped between the drive wheel 210 and idler wheel 205 thereby permitting the sheet to be propelled. When the drive wheel 210 is in the open position, the drive wheel 210 is moved away from the idler wheel 205, therefore the sheet it not gripped by the drive and idle wheels and is not propelled. With the drive wheel moved out of the sheet path, drag on the sheet is reduced as it passed through the sheet transport system 200.

With reference to FIGS. 2, 3 and 4, the follower 246 of each drive module 212 may be secured to a first end of a bracket 248 pivotally secured to the drive module frame 226. A biasing device 250 may be disposed between the bracket 248 and the frame 226. In an embodiment, the biasing device 250 in the form of a spring may be secured to a second end of the bracket and to the frame 226. Engagement of the follower by the cam 244 moves the follower 246 and the bracket 248 relative to the frame 226. The moving bracket pulls on the biasing device 250 which in turn pivots the frame 226 and drive wheel 210 secured thereto to the closed position. When the drive wheel 210 engages the corresponding idler wheel 205, the drive wheel and frame stop pivoting, but the follower 246 and bracket 248 continue to be driven by the cam 244. The further movement of the bracket 248 loads the biasing device 250 and creates a normal force between the drive wheel 210 and the idler wheel 205. When the drive module 212 is to be moved to the open position, the cam 244 may be rotated such that the cam moves away from the follower 246. Upon such movement, the normal force will be decreased as the bracket 248 moves to reduce tension on the biasing device 250. Upon further rotation of the cam 244, the cam may engage a projection 252 (FIG. 2) extending from the frame and disposed above and spaced from the follower 246. The engagement of the cam 244 with the projection 252 moves the drive wheel 210 away from the idler wheel 205, thereby opening the nip 232.

In an embodiment including three drive modules, an inboard 212*a*, a middle 212*b* and an outboard 212*c* module, the rotary drive 242 of the actuator may move to a first position rotating the camshaft 243 to cause a first response condition as shown in FIG. 5. In this first response condition, the cams engage the inboard 212*a* and outboard 212*c* modules to drive the followers 246 downwardly, thereby raising the drive wheels 210 into engagement with the corresponding idler wheels 205. With the drive wheels of the inboard 212*a* and outboard 212*c* in the closed position, a sheet extending between those drive wheels may be operated upon by the transport system 200. The middle module 212*b* may remain in the open position. This permits sheets having a width extending across the inboard and outboard idler wheels to be engaged at two points and driven through the transport system 200.

The actuator 240 may create a second response condition. As shown in FIG. 6, the rotary drive 242 of the actuator may be moved to a second position such that the camshaft engages the followers of the middle 212*b* and outboard 212*c* drive modules such that the drive wheels engage the corresponding idler wheels 205. The follower of the inboard drive module 212*a* may not be urged by the cam 244. Instead, the cam 244 may engage the frame projection 252 moving the drive wheel away from the corresponding idler wheel such that the inboard drive module 212*a* assumes the open position. With the drive wheels of the middle and outboard drive modules in the closed position, sheets having a width that extends between these two drive wheels may be engaged and moved through the nip. This second response condition can be used to accommodate sheets having widths more narrow than the first response condition.

Accordingly, by changing the position of the actuator 240, sheets of differing widths may be accommodated. Drive modules 212 not necessary for transporting the sheet may be moved to the open position, thereby reducing drag on the sheet and wear on the nip components.

The actuator rotary drive may be moved to a third position such that the cams permit all of the drive modules 212 to assume the open position (not shown). Therefore, the sheet is released from the nip permitting the sheet to be transferred or acted upon by a registration device.

While three drive modules 212 are shown and described herein, it is contemplated that any number of drive modules may be employed. Since the drive modules are independent, self-contained modules, they can easily be stacked next to each other along the support shaft with only relatively minor modification to the sheet transport system.

It is further contemplated that the actuator may include cams 244 arranged such that rotation of the camshaft 243 may cause additional and different response conditions. Accordingly, by adjusting the position of the camshaft 243 via the rotary drive 242, the particular drive modules 212, and the drive wheels 210 associated therewith, may be moved between the open and closed positions. This permits the sheet transport system 200 to be adjusted to accommodate sheets of varying widths. The actuator 240 may be configured to activate drive modules in a number of desired sequences.

The opening and closing of the nips 232 is achieved by moving the drive wheels 210 between the open and closed position. During the opening and closing of the nip, the position of the axis of rotation (A-A in FIG. 5) relative to the drive wheel of the first and second idler wheels 205 remains generally unchanged. The opening and closing of the nips does not include movement of the idler wheels 205. Therefore, the alignment in all directions of the idler wheels 205 is not compromised when the nip is opened and closed. Accordingly, the idler wheels 205 can be accurately mounted and aligned and remain accurately mounted and aligned. The hard idler wheels have a strong influence on the trajectory of the sheets passing through the transport system 200. With the accurate mounting and alignment of the idler wheels 205 maintaining the trajectory of the sheets remains substantially constant and is not skewed.

With reference to FIG. 5, the actuator 240 may be operably connected to a controller 260 which provides signals to the actuator 240 to affect the actuator position. A sheet width determinator 262, which may include a sheet sensor or an input device, may determine the width of the sheet to pass through the sheet transport system. The determinator 262 may cooperate with the controller 260 to position the drive modules 212 in the desired position for the width of the sheets entering the nips.

Figure 7:
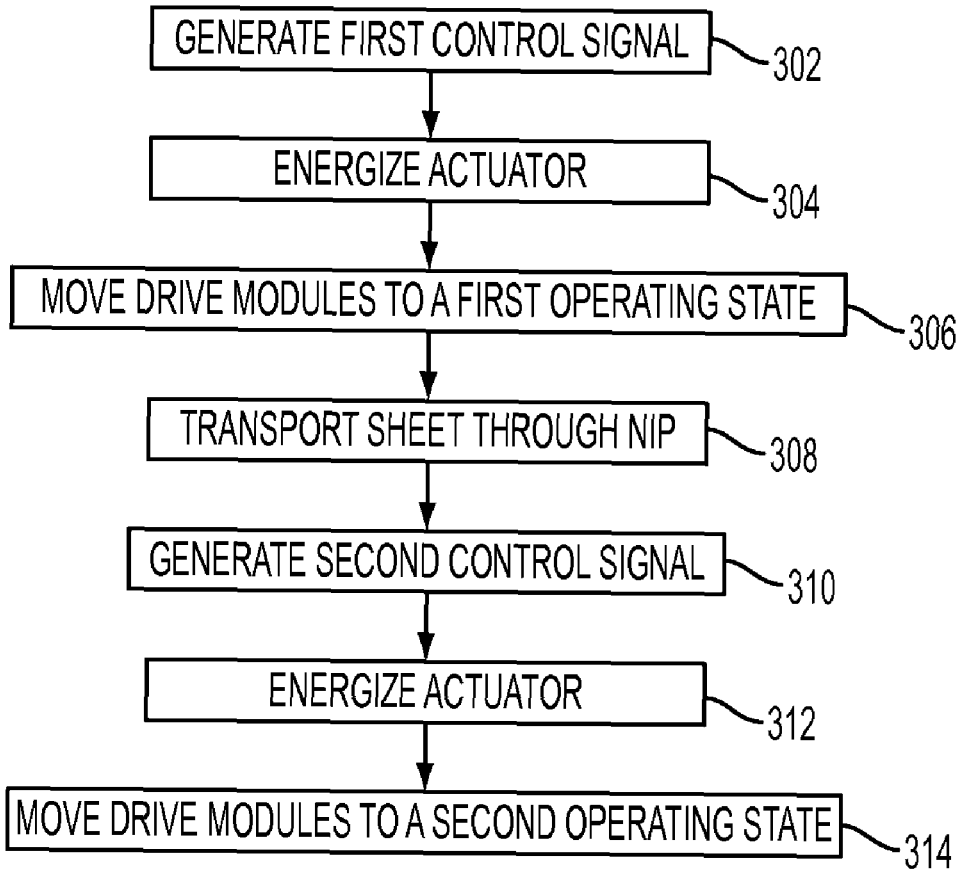
FIG. 7 depicts a flow diagram for an exemplary method of reducing sheet skew in a sheet transport system according to an embodiment.

With reference to FIG. 7, an embodiment may include an exemplary method of controlling a device to reduce sheet skew in a sheet transport system having idler wheels and drive modules according to an embodiment. The idler wheels have a substantially rigid outer layer, such as a hard plastic. The drive wheels have a substantially compliant outer layer, such as rubber, neoprene or the like. The sheet may include any media upon which a physical representation of an image may be printed or has been printed. The controller may generate a first control signal 302, thereby energizing the actuator 304. The first control signal may, for example, be responsive to a signal corresponding to a width of the sheet. In response to the control signal, the energized actuator moves the drive modules 306 such that they assume a first operating state. A sheet may then be transported through the nips 308 by action of the drive wheels. A second control signal may be generated 310, thereby again energizing the actuator 312. The second control signal may be in response to the location of the sheet in the nips. In response to the signal, the actuator moves the drive modules 314 such that they assume a second operating state such as an open position to release the sheet from the nips.

In an embodiment having three drive modules, upon sensing that the sheet has a first width, the controller may generate a first control signal to the actuator. In response to the first control signal, the actuator may cause the inboard and outboard drive modules to pivot such that the drives wheels move from an open position into the closed position wherein the drive wheels can contact a sheet. The middle module may be moved into the open position wherein the sheet is not contacted by the corresponding drive wheel. Therefore, the sheet may be transported through the nip.

In response to sensing a sheet having a second width, the controller may generate and send a second signal to the actuator. In response to the signal, the actuator may cause the middle and outboard drive modules to pivot such that the drives wheels move from an open position into the closed position wherein the drive wheels can contact a sheet. The inboard module may be moved into the open position wherein the sheet is not contacted by the corresponding drive wheel. Therefore, the sheet may be transported through the nip.

When the sheet has been transported through the nips (or at least transported sufficiently such that it may be further transported by an adjacent nip or other transporting device), the drive modules 212 may all be moved to the open position. The sheet is then released from the sheet transport system 200 and may be further transported for processing.

It will be appreciated that various of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the disclosed embodiments.

What is claimed is:

1. A sheet transport system comprising:

a first drive module including a frame, a first drive wheel rotatably disposed on the frame, a first drive motor operably connected to the first drive wheel and disposed on the frame, the first drive module being pivotally secured to a structure;

a first idler wheel corresponding to the first drive wheel; and an actuator operably engagable with the first drive module, wherein the actuator is configured to move the first drive module to cause the first drive wheel to move between an open position and a closed position, wherein the first drive wheel is configured to propel a sheet in the closed position and to not propel a sheet in the open position, and wherein the actuator includes a first cam engagable with a first cam follower disposed on the first drive module, and the first cam follower is pivotally secured to the frame and a biasing device is disposed between the first cam follower and the frame.

2. The sheet transport system of claim 1, wherein the first drive wheel has a compliant outer layer.

3. The sheet transport system of claim 1, wherein the first idler wheel has a substantially rigid outer layer.

4. The sheet transport system of claim 1, wherein the actuator includes a rotary drive and the first cam is operably connected to a camshaft.

5. The sheet transport system of claim 1, further comprising:

a second drive module including a frame, second drive wheel rotatably disposed on the frame, and a second drive motor operably connected to the second drive wheel and disposed on the frame, the second drive module being pivotally secured to the structure;

a second idler wheel having a substantially rigid outer layer, and the second drive wheel corresponds to the second idler wheel.

6. The sheet transport system of claim 5, wherein the actuator is operably engagable with the second drive module and configured to move the second drive module to cause the second drive wheel to move between a closed position and an open position, wherein the second drive wheel is configured to propel a sheet in the closed position and to not propel a sheet in the open position.

7. The sheet transport system of claim 6, wherein a position of the first and second idler wheels is not displaced when the first and second drive wheels are moved between the open and closed position.

8. The sheet transport system of claim 5, wherein the actuator produces a first response condition wherein the first drive wheel is in the closed position and the second drive wheel is in the open position.

9. The sheet transport system of claim 8, wherein the actuator produces a second response condition wherein the first drive wheel is in the open position and the second drive wheel is in the closed position.

10. The sheet transport system of claim 5, wherein the structure includes a support shaft extending through an opening formed in the frame of the first and second drive modules.

11. A sheet transport system, comprising:

a plurality of drive modules each including a drive wheel and a drive motor operably connected to the drive wheel, the plurality of drive modules being pivotally secured to a common support shaft;

a plurality of idler wheels with one of the plurality of idler wheels corresponding with one the plurality of drive wheels; and an actuator operably engagable with the plurality of drive modules, wherein the actuator is configured to cause the drive wheels of the plurality of drive modules to selectively pivot about the common support shaft independently of each other between a closed sheet engaging position and an open non-sheet engaging position.

12. The sheet transport system of claim 11, wherein each of the plurality of drive modules is aligned in side-by-side arrangement along the support shaft.

13. The sheet transport system of claim 11, wherein the actuator produces a response condition wherein a first and second drive module of the plurality of drive modules are moved to the closed position and a third drive module of the plurality of drive modules disposed between the first and second drive modules is moved to the open position.

14. The sheet transport system of claim 11, wherein the actuator produces a response condition wherein the first drive module is moved to the open position and the second and third drive modules are moved to the closed position.

15. The sheet transport system of claim 11, wherein the actuator includes a rotary drive, and rotation of the drive to a first position produces a first drive module response condition and rotation to a second position produces a second drive module response condition.

16. The sheet transport system of claim 11, wherein the actuator produces a response condition wherein all of the plurality of drive modules are moved to the closed position.

17. The sheet transport system of claim 11, wherein the actuator is configured to cause the plurality of drive wheels to independently move between the closed and open positions in response to a width of a sheet of media.

18. The sheet transport system of claim 11, wherein the actuator includes a first cam engagable with a first cam follower disposed on one of the plurality of drive modules, the drive module including a frame and the drive wheel is rotatably disposed on the frame, and the first cam follower is pivotally secured to the frame and a biasing device is disposed between the first cam follower and the frame.

19. A method of controlling a sheet transport system to reduce sheet skew, the method comprising:

energizing an actuator to move a drive module including a drive wheel and a drive motor from an open position to a closed position, the actuator including a first cam engagable with a first cam follower disposed on the drive module, and the first cam follower is pivotally secured to a drive module frame and a biasing device is disposed between the cam follower and the drive module frame, the drive wheel cooperating with an idler wheel to form a nip, wherein the idler wheel comprises a substantially rigid outer layer, wherein the drive wheel comprises a substantially compliant outer layer, wherein the drive wheel is configured to not propel a sheet in the open position and is configured to propel a sheet in the closed position;

transporting a sheet through the nip by action of the drive wheel; and energizing the actuator to move the drive module from the closed position to the open position.

* * * * *